US006095688A

United States Patent [19]

Nittel et al.

[11] Patent Number: 6,095,688

[45] Date of Patent: Aug. 1, 2000

[54] STABILIZED, CUBIC, FLEXIBLE CONTAINER

[75] Inventors: Cornelius Nittel, Wiesbaden; Wolfgang Werner, Ruesselsheim, both of Germany

[73] Assignee: Nittel Halle GmbH, Halle/Saale, Germany

[21] Appl. No.: 09/182,010

[22] Filed: Oct. 29, 1998

[30] Foreign Application Priority Data

Nov. 7, 1997 [DE] Germany ..... 197 49 352

[51] Int. Cl.[7] ..... B65D 30/10

[52] U.S. Cl. ..... 383/105; 229/117.27; 383/41; 383/120

[58] Field of Search ..... 383/41, 67, 105, 383/119, 120; 229/117.27, 117.35

[56] References Cited

U.S. PATENT DOCUMENTS 5,071,025 12/1991 Boots ..... 229/117.27
5,282,544 2/1994 Boots ..... 229/117.27
5,328,267 7/1994 Cuddy et al. ..... 383/105
5,556,205 9/1996 Gallie et al. ..... 383/105
5,649,767 7/1997 Nickell et al. ..... 383/105
5,685,644 11/1997 Taylor ..... 383/105
5,873,655 2/1999 Echiverria ..... 383/105

*Primary Examiner*—Gary E. Elkins
*Attorney, Agent, or Firm*—Oblon, Spivak, McClelland, Maier & Neustadt, P.C.

[57] ABSTRACT

A stabilized, flexible, cubic container is provided, in which the stabilization is achieved by a continuous, tubular basic part which includes punched-out or cut-out sections. The basic tube is preferably in the form of a gusseted tube, of which the non-filled volume is provided in the corner regions via outer pocket-like material adaptions. The inner, open edges of the outer pocket-like material adaptions are connected with sealing action to the basic tube in an overlapping manner directly behind the punched-out or cut-out sections.

10 Claims, 3 Drawing Sheets

STABILIZED, CUBIC, FLEXIBLE CONTAINER

BACKGROUND OF THE INVENTION

Various attempts have been made in the packaging industry to stabilize large-volume boxes, pliable-walled, i.e., semi-rigid, folding containers or foldable bulk containers (FIBC).

It is primarily the action of the side-wall surfaces, which tend to bulge beyond their predetermined surface area, which should be prevented. In particular, in the case of outer packaging having compliant wall surfaces, it could be established that these did not withstand the pressure of free-flowing dry products.

It was possible to avoid the above-described disadvantages of the boxes to a sufficient extent by providing an octagonal insert.

In the case of flexible containers, which are usually produced from strong fabrics (FIBC), additional wall parts, which were sewn in over the corners, had an advantageous pressure-relieving effect. However, in many cases, as a result of product protection, use is to be made of film liners which, with an inner chamber formation of the container, cannot be designed appropriately as far as the walls are concerned. It has thus been necessary, in such cases, to stabilize the film liner itself. The low wall thickness of films meant that only welding was considered for production purposes. The stabilization has been achieved by a round strap (inner ring) with a particular restraining force being welded in separately as shown in EP-A1-0 276 878 ("the EP '878 reference"). In the method of the EP '878 reference, an already preformed flexible liner has to be opened somehow in order to weld an inner ring to the insides of the film. This laborious, and not always reliable, adaption operation is indeed avoided by the production method disclosed in U.S. Pat. No. 5,618,255, because the strap and outer bag are first of all connected in the open, flat state, but the subsequently necessary formation of a gusseted tube of a number of meters in width and length has proven to be obviously difficult. The concluding formation of the inlet and outlet stub requires separate production.

All the production methods which have been devised up to now for this purpose are thus extremely time-consuming and thus costly. In many cases, it is not possible to achieve the necessary strength for a weld seam for the event where the latter is subjected to tensile stressing.

SUMMARY OF THE INVENTION

The object of the present invention was therefor to develop a reliable, stabilized, flexible container which is produced in cubic form and which does not exhibit the disadvantages of the containers produced by known methods. This was achieved according to the present invention by providing a continuous, tubular element for stabilization purposes. The continuous, tubular element includes punched-out or cut-out sections and is preferably in the form of a gusseted tube which has a non-filled volume in the corner regions thereof. The corner regions are formed by outer material adaptions. Such material adaptions are made from flat materials which are attached firmly to the basic tube and which are connected with sealing action thereto, as is described in specific terms hereinbelow. In contrast to the previous or subsequent introduction of a stabilizing strap, this type of construction achieves the stabilization with the continuous inner tube as the starting point for production. This element, which may be referred to as a basic tube, may be a film tube or a gusseted tube. This basic concept has the advantage that all other production steps can start on the outside of a seamless basic tube, preferably a gusseted tube.

A further advantage over other production methods lies in the avoidance of a large number of weak points, which may occur when a strap is subsequently welded on the inside. Examples of weak points include tearing of the seams by tensile stressing with peeling action, weld faults, and positional inaccuracies, as well as contamination by a tube being opened. In contrast, the stabilizing column of the continuous basic tube, according to the present invention, is not weakened by any inner seams. Shifts in position are not possible either, for the very reason that no strap is introduced. The inner surface of the basic tube is protected from contamination since the tube does not have to be opened. Moreover, the outer material adaptions, in the form of flat films or half-tubes, ensure a low amount of particles for production. All the subsequently provided adaptions are attached to the basic tube from the outside.

The basic tube, which even as a gusseted tube constitutes a tubular element, has to have a sufficient number of suitable punched-out or cut-out sections in order to ensure, during a later filling operation, friction-free material throughflow into the pocket-forming outer material adaptions. The same applies for the emptying operation.

In the next step, the film tube is provided, over the individual gussets, with material webs from the outside. These may be in the form of either eight flat films or four half-tubes. Half-tubes are produced by a laterally slit film tube or by flat films folded congruently one above the other. A slight opening in the half-tubes allows, in each case, one side to be positioned above and one side to be positioned beneath the film of the basic tube. This means that the outer material adaptions from outer pockets which, by means of an appropriate longitudinal weld over the entire length of the subsequent container, are connected to the basic tube, or the representative tube gusset, at the top and bottom in an overlapping manner directly behind the punched-out or cut-out sections. These supplementary outer pockets the fill the corner area of subsequent container, insofar as this area cannot be reached by the inner, reduced volume film tube. Indeed, this must not happen since it is only possible for a film tube to absorb the high pressure of the free-flowing contents when in this form, i.e., as a film tube in the interior with much smaller dimensioning than the outer periphery of the container. The rest of the filling area in the comers is enclosed by the outer pockets and is subjected to considerably lower pressure there. If, instead of providing four half-tubes, use is made of eight flat films, which later have to be welded closed at the still-open outer edges, the web guidance and the processing is particularly straightforward and reliable.

Finally, the basic tube, supplemented with outer material adaptions, in the form of a gusseted tube, is subjected, in the flat state, to a known contour-welding operation at the corners, a so-called bottleneck being formed as a result. This bottleneck serves both as a filling stub and as an outlet stub and forms a unit with a tubular element, that is to say, with the stabilizing basic tube.

It is primarily plastic films which are suitable materials to use here. However, it is also possible to use other materials (e.g. paper). A suitable connecting method to use in the case of plastics is preferably welding, but other connection methods using seams and adhesive bonding are also possible.

Containers which are stabilized in this way are suitable, not just for large container, but also for smaller containers, if the contents thereof cause a change in shape as a result of the wall bulging. In many cases up until now, it was only possible to avoid this bulging effect by using strong-walled outer packaging. It is now possible for the desired cubic package shape to be maintained even with just this protective packaging.

The shaping of a stabilized inner sleeve is variable. Different side lengths are likewise possible, as are filling and outlet stubs of any desired shape. Correct dimensioning of the inner tube column can achieve very good stability, with the result that, in this case, if appropriate, it is possible to dispense with outer packaging completely.

BRIEF DESCRIPTION OF THE DRAWING FIGURES

Further details and advantages of the present invention can be gathered from the designs illustrated in the drawing figures.

Figure 2:
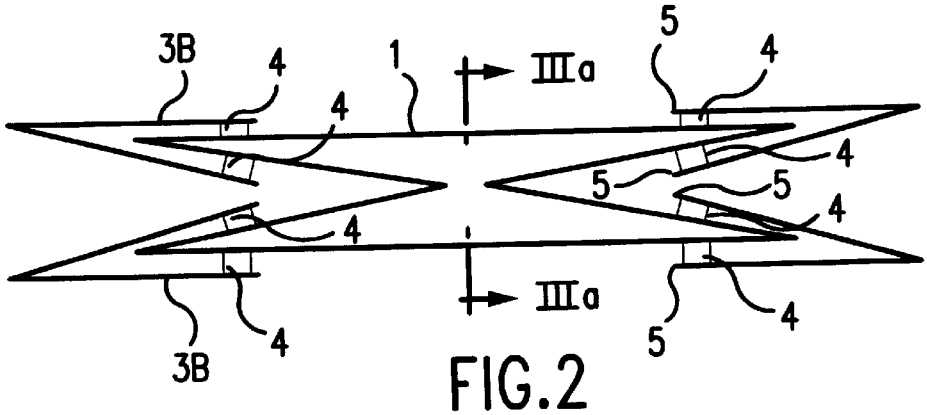
FIG. 2 is a cross-sectional view, taken along line II—II of FIG. 1, through the basic tube, in the flat state, which in this case, is in the form of a gusseted tube with material supplements in the form of half-tubes.
Figure 3A:
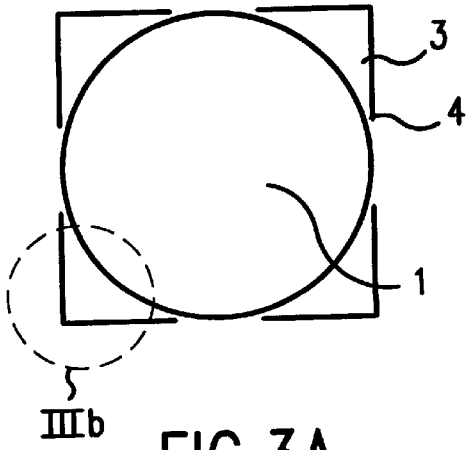

FIG. 3*a* is a cross-sectional view through the basic tube taken along line IIIa—IIIa of FIG. 2, but the basic tube is in the opened-out state instead of the flat or compressed state as shown in FIG. 2.

Figure 3B:
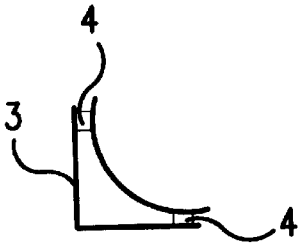

FIG. 3*b* is a detailed view of circle IIIb shown in FIG. 3*a*.

Figure 1:
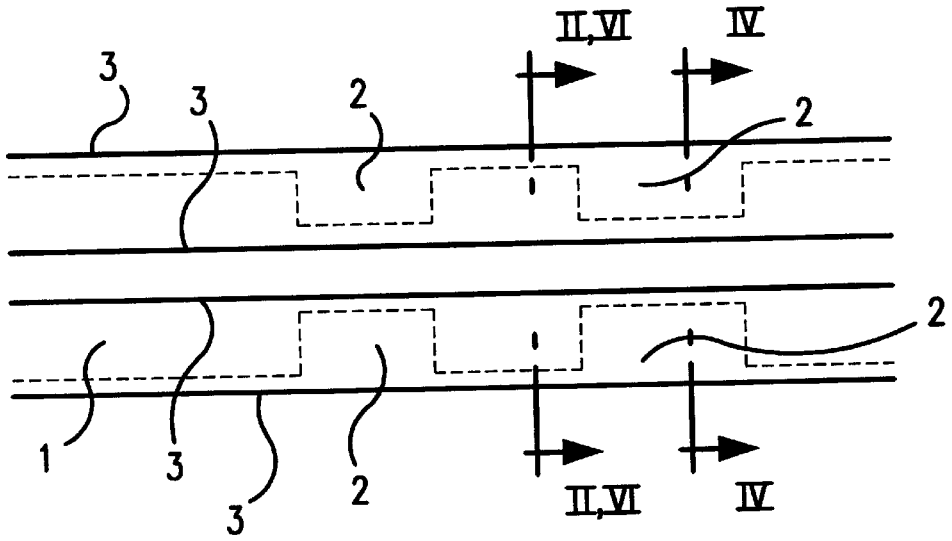
FIG. 1 is a plan view of a basic tube in the flat state with punched-out or cut-out sections and outer material supplements.
Figure 4:
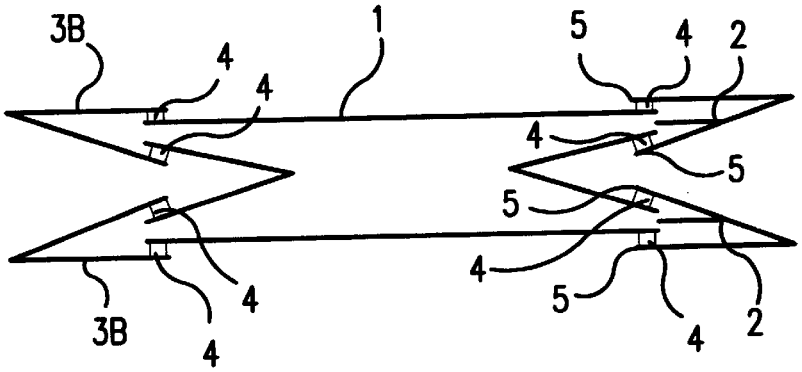

FIG. 4 is a cross-sectional view, taken along line IV—IV of FIG. 1, through the basic tube of FIG. 2, wherein the basic tube is in the flat or compressed state.

Figure 5:
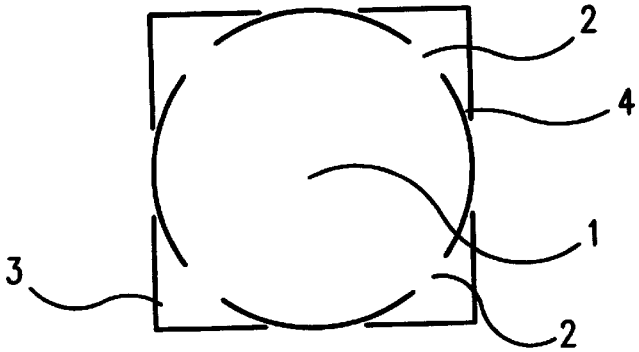

FIG. 5 us a side view of the basic tube according to FIG. 4, except in the opened-out state.

Figure 6:
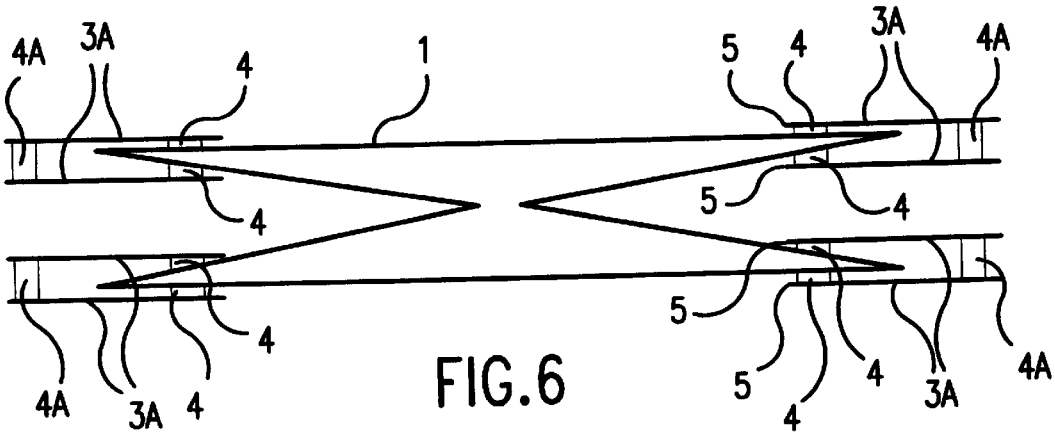

FIG. 6 is a cross-sectional view, taken along line VI—VI of FIG. 1, through the basic tube, in the flat or compressed state, which is in the form of a gusseted tube and has material supplements in the form of eight flat films.

Figure 7:
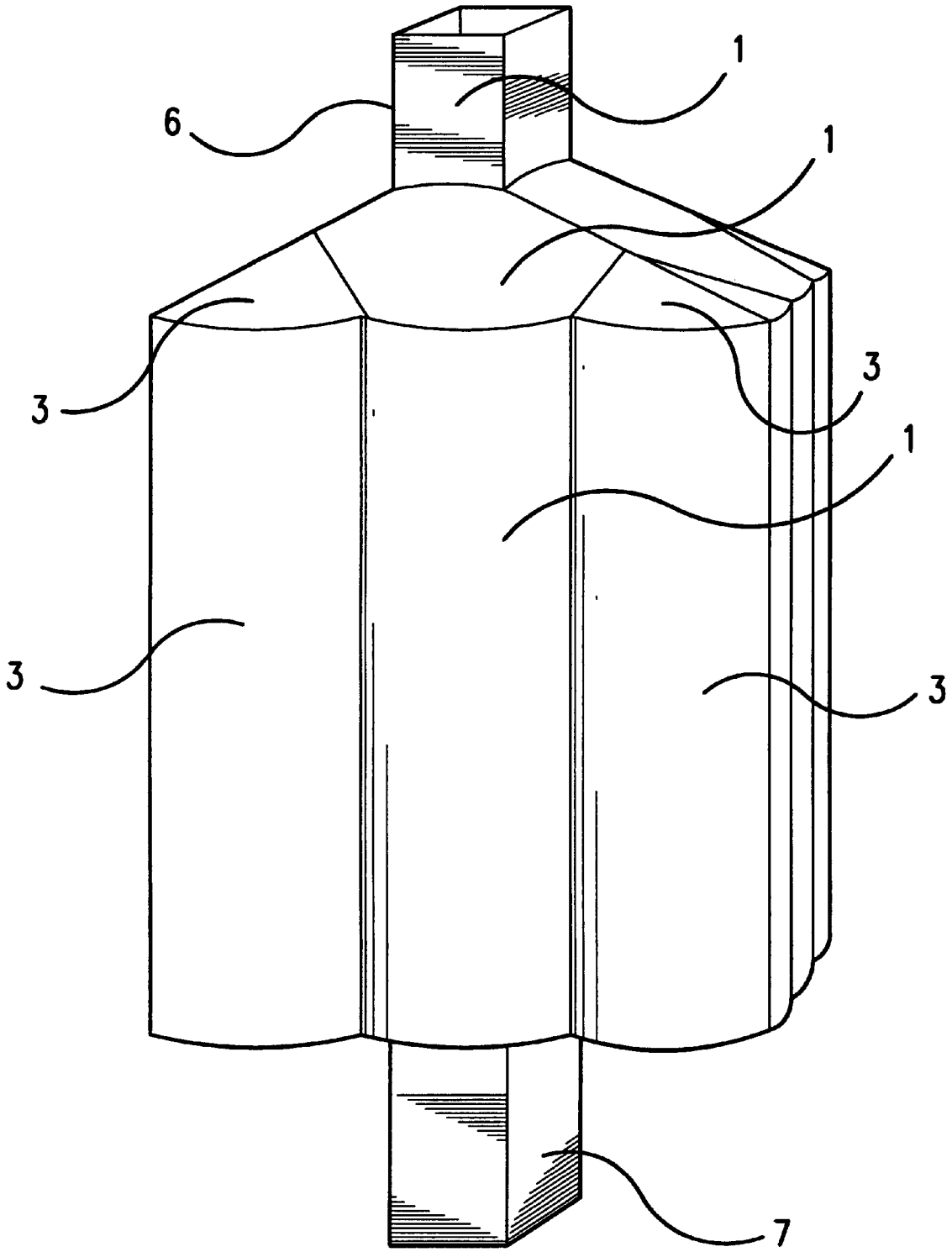

FIG. 7 is a perspective view of an opened-out container with inlet and outlet stubs according to the present invention.

BRIEF DESCRIPTION OF THE PREFERRED EMBODIMENTS

In the production of a container according to the present invention, a basic tube 1, which is drawn off from a roll as a blank and which is preferably a gusseted tube material, is provided with lateral punched-out or cut-out sections 2. The lateral punched-out or cut-out sections 2 are supplemented by material adaptions 3. The supplementing of the material adaptions 3 is carried out such that the material web of the material adaptions 3 covers the punched-out or cut-out sections 2 to a sufficient extent (FIG. 1). Thus, as the container is beginning to be filled with product, the product begins to fill the basic tube 1 and the corner regions formed by the material adaptions have an unfilled volume until the product reaches the punched-out or cut-out sections 2 to be able to being filling the corner regions created by the material adaptions 3. To aid understanding, the possible cross-sections of the container are illustrated specifically in FIGS. 2, 4, and 6 via the section lines II—II, VI—VI, and IV—IV of FIG. 1.

When a gusseted tube is used as the basic tube 1, it is advantageous to have overlapping by material adaptions 3 in the form of flat films 3A or half-tubes 3B at the gussets (FIGS. 2 and 6, respectively). The inwardly open ends or edges 5 of the half-tubes 3B have to be connected to the surface of the basic tube 1 from outside of the basic tube 1. When flat films 3A are used, these must additionally be closed at the outer edges (near connection 4A in FIG. 6). The type of material connections 4 and 4A depends on the web material selected. For instance, if the material of the basic tube 1 is a plastic film or a co-extrusion film (i.e., a special plastic film produced by co-extruding at least two different plastic materials, wherein one of the plastic materials exhibits considerably less expansion than the other plastic material, wherein the plastic material used for the outer layer of the basic tube 1 is the same plastic as is used for the material adaptions 3, and wherein the plastic material used for the inner layer of the basic tube 1 has a considerably higher melting point than the plastics material used for the outer layer), preferably in the form of a gusseted tube blank, then the basic tube 1 is connected to the outer pocket-like material adaptions 3 by extrusion. If the material of the basic tube 1 is paper, then the basic tube 1 is connected to the outer pocket-like material adaptions 3 by adhesive bonding. If the material of the basic tube 1 is fabric, more preferably polypropylene fabric, then the basic tube 1 is connected to the outer pocket-like material adaptions 3 by being sewn thereon. With other materials forming the basic tube 1, welded connections could be appropriate.

In the opened-out or expanded state, the basic tube 1, along with the material adaption 3 connected to the outside thereof, forms a square surface area in cross-section (FIG. 3*a*). The points of connection 4 are illustrated in FIG. 3*b*.

The position of the punched-out or cut-out sections 2 with the overlap is illustrated by section line IV—IV in FIG. 1. The cross-sectional view is shown in FIG. 4. The points of connection 4 to the outside of the basic tube 1 are to be understood as running throughout as a seam, with the result that the material adaptions 3, which form pockets in the folded-out or expanded state, can only be filled with, and emptied of, product via the punched-out or cut-out sections 2. In other words, the product can only emerge into the pocket-forming material adaptions 3 via the punched-out or cut-out sections 2, because the web ends of the pocket-forming material adaptions 3 are connected to the basic tube 1 by continuous seams 4 or, in the base of flat films 3A being used, are subsequently welded closed at the outer edges (see connections 4A). This is illustrated in FIG. 6.

In the specific embodiment shown in FIG. 6, the container of the present invention has four outer material adaptions 3 forming four pockets, wherein the four outer material adaptions 3 are constituted of eight flat webs 3A. Each of the eight flat webs 3A have a first end or edge which is connected to the basic tube 1 with sealing action to form material connections 4. The material connections 4 are accomplished by welding. Each of the eight flat webs 3A have a second end or edge which is connected to asecond end or edge of another one of the eight flat webs 3A to form material connections 4A.

In the specific embodiment shown in FIG. 4, the container of the present invention has four outer material adaptions 3 forming four pockets, wherein the four outer material adaptions 3 are constituted by four half-tubes 3B. Each of the four half-tubes 3B have first and second ends or edges which are connected to the basic tube 1 with sealing action to form material connections 4 at the inner, open ends or edges 5 adjacent to the punched-out or cut-out sections 2 of the basic tube 1. The material connections 4 are accomplished by welding.

Depending on the desired size and nature of the container, the start and end of a multi-layer material web produced in this way may open-out or expand into an inlet stub 6 and outlet stub 7 as illustrated in FIG. 7. These stubs 6, 7 form an integral part of the basic tube 1 and together the stubs 6, 7 and the basic tube 1 form a unit. The cubic nature of the container is particularly clear in this formation. The action of bulging beyond the square basic surface area is prevented by the basic tube 1 since the basic tube 1 is restricted in diameter to the edge of the basic surface area. Most of the dynamic pressure of the contents is absorbed in this tube column. The rest of the contents are distributed, via the punched-out or cut-out sections 2, into the outer pockets 3, which permit only negligible bulging. If such a container is placed in a flexible or pliable-walled outer container (e.g. FIBC or corrugated-cardboard box), the straight-walled surfaces of the flexible or pliable-walled outer container delimits the cubic form completely.

What is claimed is:

1. A stabilized, flexible, cubic container, comprising:

a basic part formed from a blank of continuous, gusseted tubular material;

punched-out sections at spaced intervals along said basic part;

outer material adaptions forming corner regions;

a volume to be filled is defined within said basic part of said container;

an initially non-filled volume of said container is provided in said corner regions inner, open edges of said outer material adaptions are sealingly connected to said basic part in an overlapping manner to form seams which are located directly behind said punched-out sections.

2. The container according to claim 1, wherein said outer adaptions form four pockets made up of eight flat webs having inner, open edges and outer open edges, said inner open edges being sealingly connected by welding to said basic part to form seams, and said outer, open edges being sealingly connected to each other to close said outer adaptions to form said four pockets.

3. The container according to claim 1, wherein said outer adaptions form four pockets, said outer adaptions each being made of a half-tube sealingly connected by being welded to said basic part at said inner, open edges thereof.

4. The container according to claim 1, wherein a material of said basic part is a plastic film, and the basic part is a gusseted blank, said gusseted blank being produced from a material substantially identical to a material used to make said outer adaptions.

5. The container according to claim 4, wherein a material of said basic part is a plastic film made of at least two different materials which have been co-extruded with respect to each other, a first material of said at least two different materials exhibiting considerably less expansion than a second material of said at least two different materials, and an outer layer of said basic part being made of a material similar to a material of said outer adaptions.

6. The container according to claim 4, wherein a material of said basic part is a plastic film made of at least two different materials which have been co-extruded with respect to each other, and an inner layer of said basic part having a considerably higher melting point than said outer layer, said outer layer being made of a substantially identical material as said material of said outer adaptions.

7. The container according to claim 1, wherein said basic part is made up of a plastic fabric, and said outer adaptions are formed from an extruded plastic film.

8. The container according to claim 1, wherein said container is made of paper, and said basic part is connected to said outer adaptions by adhesive bonding.

9. The container according to claim 1, wherein said container is made of a polypropylene fabric, and said basic part is connected to said outer adaptions by being sewn thereon.

10. The container according to claim 1, further comprising inlet and outlet regions forming a unit with said basic part.

* * * * *